United States Patent [19]

Yamato

[11] Patent Number: 4,643,152

[45] Date of Patent: Feb. 17, 1987

[54] METHOD FOR CONTROLLING THE FUEL SUPPLY OF AN INTERNAL COMBUSTION ENGINE

[75] Inventor: Akihiro Yamato, Shiki, Japan

[73] Assignee: Honda Giken Kogyo Kabushiki Kaisha, Tokyo, Japan

[21] Appl. No.: 736,700

[22] Filed: May 22, 1985

[30] Foreign Application Priority Data

May 23, 1984 [JP] Japan ..... 59-104315

[51] Int. Cl.[4] ..... F02M 51/00

[52] U.S. Cl. ..... 123/480; 123/492; 123/493; 364/431.05

[58] Field of Search ..... 123/438, 478, 480, 492, 123/493; 364/431.04, 431.05, 431.06

[56] References Cited

U.S. PATENT DOCUMENTS

| | | | |
|---|---|---|---|
| 4,424,568 | 1/1984 | Nishimura et al. | 123/493 X |
| 4,440,119 | 4/1984 | Kobayashi et al. | 123/493 X |
| 4,508,086 | 4/1985 | Ito et al. | 123/493 X |
| 4,548,180 | 10/1985 | Yamato | 123/480 X |

*Primary Examiner*—Willis R. Wolfe, Jr.

*Attorney, Agent, or Firm*—Birch, Stewart, Kolasch & Birch

[57] ABSTRACT

A method for controlling the fuel supply of an internal combustion engine having a throttle valve in the intake air system is provided. It is detected that the crankshaft of the engine is at a predetermined crankshaft angular position. At every detection of this crankshaft position, the pressure in the intake air passage downstream of the throttle valve is detected. The present reference value $P_{BAVEn}$ having predetermined functional relations regarding the present detection value $P_{BAn}$ of the pressure in the intake air passage and the preceding reference value $P_{BAVE(n-1)}$ is set. The amount of the fuel supply into the engine is determined on the basis of this present reference value $P_{BAVEn}$. The presumptive value of the intake air absolute pressure is calculated in consideration of the correction values with respect to the time lag in control operation and to the fuel deposition on the wall surface in the intake air manifold. Therefore, the proper reference fuel supply amount into the engine can be accurately determined, so that a driveability is improved.

18 Claims, 7 Drawing Figures

| FIG.4 (a) | FIG.4 (b) |
|---|---|

METHOD FOR CONTROLLING THE FUEL SUPPLY OF AN INTERNAL COMBUSTION ENGINE

BACKGROUND OF THE INVENTION

1. Field of the Invention

The present invention relates to a method for controlling the fuel supply of an internal combustion engine.

2. Description of the Prior Art

There are fuel injection types for injecting and supplying the fuel into an internal combustion engine of automobiles or the like by an injector. Among these types, there is a type in which: a pressure in the intake air passage downstream of the throttle valve of the intake air system and an engine rotating speed are detected; a basic fuel injection time duration $T_i$ is determined at the period synchronized with the engine rotating speed in accordance with the result of detection; further, an increase or decrease correcting coefficient is multiplied to the basic fuel injection time duration $T_i$ in accordance with other engine operation parameters such as an engine coolant temperature or the like, or with a transient change of the engine; and thereby determining a fuel injection time duration $T_{out}$ corresponding to the amount of the required fuel injection.

In such a fuel supply control method, there is a time lag in the control operation from the detection of the pressure in the intake air passage until the fuel is actually injected. When the pressure in the intake air passage varies as in the acceleration or deceleration of the engine, the pressures in the intake air passage when it is detected and when the fuel is injected differ. Therefore, the pressure in the intake air passage upon fuel injection is presumed on the basis of the change in the pressure in the intake air passage detected already. Then, the basic fuel injection time duration is determined using this presumptive value.

On the other hand, fuel adheres to the wall surfaces of the intake air manifold during operation of the engine and its amount of deposition differs depending on the operating state. Practically speaking, in the decelerating operation of the engine, an absolute pressure in the intake manifold is lower than that in the accelerating operation and the fuel deposited onto the wall surface in the intake manifold is drawn into the engine, so that the time duration until the deposition amount becomes stable becomes long. Therefore, for improvement in operation state, it is desirable to add a correction value regarding the fuel adhered onto the wall surface in the intake manifold to the presumptive value of the pressure in the intake air passage in the case where this pressure varies.

SUMMARY OF THE INVENTION

It is an object of the present invention to provide a method for controlling the fuel supply in which the presumptive value of the pressure in the intake air passage including the correction value for the fuel adhered onto the wall surface in the intake manifold as well as the correction value for the time lag in the control operation is calculated and the basic amount of fuel injection is determined thereby improving a driveability.

According to a fuel supply controlling method of the invention, the time point when the crankshaft of the engine is at a predetermined crankshaft angular position is detected; the pressure in the intake air passage downstream of the throttle valve is detected whenever the above-mentioned detection regarding the crankshaft angular position is performed; the present reference value $P_{BAVEn}$ having a predetermined functional relationship with the present detection value $P_{BAn}$ of the pressure in the intake air passage and the preceding reference value $P_{BAVE(n-1)}$ one sampling before is set; and the amount of the fuel supply into the engine is determined on the basis of the present reference value $P_{BAVEn}$.

BRIEF DESCRIPTION OF THE DRAWINGS

FIGS. 4, 4*a* and 4*b* are flow charts for the operation of the control circuit showing an embodiment of the invention.

DETAILED DESCRIPTION OF THE PREFERRED EMBODIMENT

An embodiment of the present invention will now be described in detail hereinbelow with reference to FIGS. 1 to 6.

Figure 1:
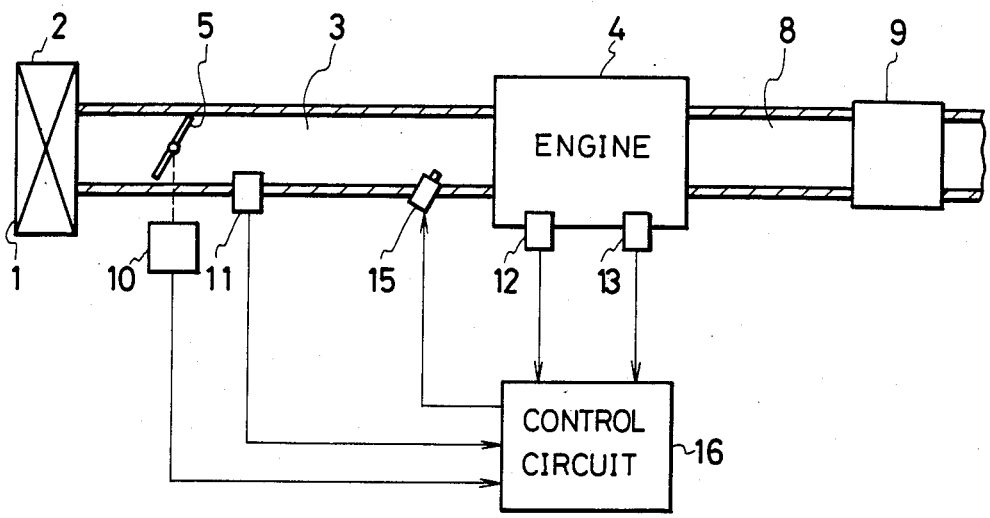
FIG. 1 is an arrangement diagram showing an apparatus for supplying the fuel of the electronic control type to which a method for controlling the fuel supply according to the present invention is applied.

Referring to FIG. 1, there is shown an apparatus for supplying the fuel, of the electronic control type, to which a method for controlling the fuel supply according to the present invention is applied. In this apparatus, the intake air is supplied from an air intake port 1 to an engine 4 through an air cleaner 2 and an intake air passage 3. A throttle valve 5 is provided in the passage 3 and an amount of intake air into the engine 4 is changed depending on the angular position of the throttle valve 5. Three way catalyst 9 is provided in an exhaust gas passage 8 of the engine 4 to promote a decrease in amount of harmful components (CO, HC and NOx) in the exhaust gas.

A throttle position sensor 10 consists of, for example, a potentiometer and generates an output voltage of the level responsive to the angular position of the throttle valve 5. An absolute pressure sensor 11 is provided downstream of the throttle valve 5 and generates an output voltage of the level corresponding to a magnitude of the pressure. A coolant temperature sensor 12 generates an output voltage of the level according to a temperature of the cooling water (or coolant) which cools the engine 4. A crankshaft angular position sensor 13 generates a pulse signal in response to the rotation of a crankshaft (not shown) of the engine 4. For instance, in case of a four-cylinder engine, a pulse is generated from the sensor 13 whenever the crankshaft is rotated by an angle of 180°. An injector 15 is provided in the intake air passage 3 near an intake valve (not shown) of the engine 4. Each output terminal of the sensors 10 to 13 and an input terminal of the injector 15 are connected to a control circuit 16.

Figure 2:
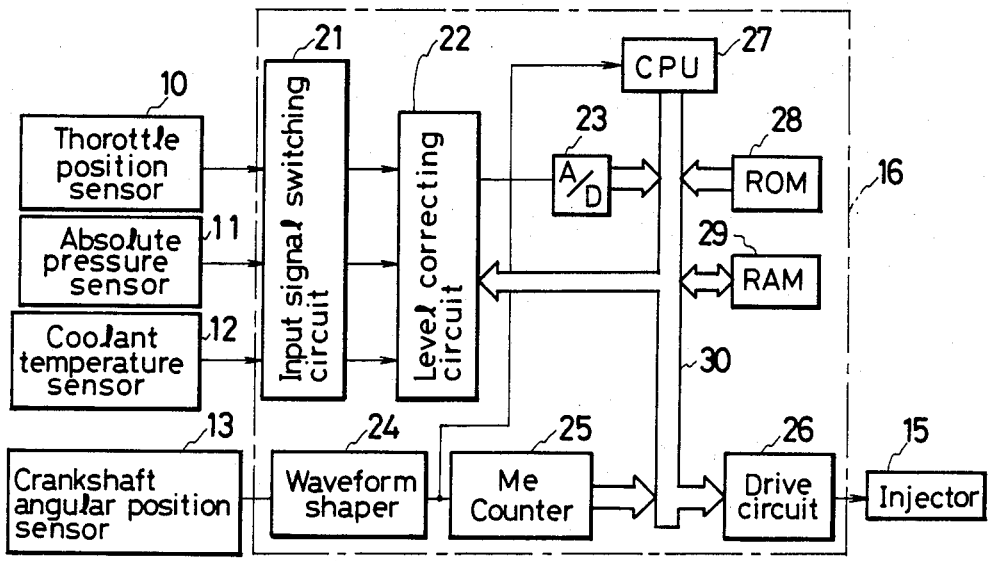
FIG. 2 is a block diagram showing a practical arrangement of a control circuit in the apparatus shown in FIG. 1.

As shown in FIG. 2, the control circuit 16 comprises: a level correcting circuit 21 to correct the level of each output from the throttle position sensor 10, absolute pressure sensor 11 and coolant temperature sensor 12; an input signal switching circuit 22 to selectively output one of the respective sensor outputs derived through the level correcting circuit 21; an A/D (analog-to-digital) converter 23 to convert the analog signal outputted from the switching circuit 22 to the digital signal; a signal waveform shaping circuit 24 to shape the waveform of the output of the crankshaft angular position sensor 13; a Me counter 25 to measure the time duration between TDC signals which are outputted as pulses from the waveform shaper 24; a drive circuit 26 to drive the injector 15; a CPU (central processing unit) 27 to perform the digital arithmetic operation in accordance with a program; a ROM (read only memory) 28 in which various kinds of processing programs and data have been stored; and a RAM (random access memory) 29. The input signal switching circuit 22, A/D converter 23, Me counter 25, drive cricuit 26, CPU 27, ROM 28, and RAM 29 are connected to an I/O (input-/output) bus 30. The TDC signal from the waveform shaper 24 is supplied to the CPU 27 for interrupting operation. As shown in FIG. 2, the sensors 10 to 12 are connected to the level correcting circuit 21, while the sensor 13 is connected to the waveform shaper 24.

In the above-mentioned arrangement of the control circuit 16, the information representative of an angular position $\theta_{th}$ of the throttle valve, an intake air absolute pressure $P_{BA}$ and a coolant temperature $T_W$ is selectively supplied from the A/D converter 23 to the CPU 27 through the I/O bus 30. In addition, the information of a count value $M_3$ indicative of the inverse number of a rotating speed $N_3$ of the engine is supplied from the counter 25 to the CPU 27 through the I/O bus 30. The arithmetic operating program for the CPU 27 and various kinds of data have been preliminarily stored in the ROM 28. The CPU 27 reads the foregoing respective information in accordance with this operating program and data and determines the fuel injection time duration of the injector 15 corresponding to the amount of the fuel supply into the engine 4 on the basis of this information synchronously with the occurrence of the TDC signal using a predetermined calculating equation. The CPU 27 allows the drive circuit 26 to drive the injector 15 for only the fuel injection time duration thus derived, thereby supplying the fuel into the engine 4.

Figure 3:
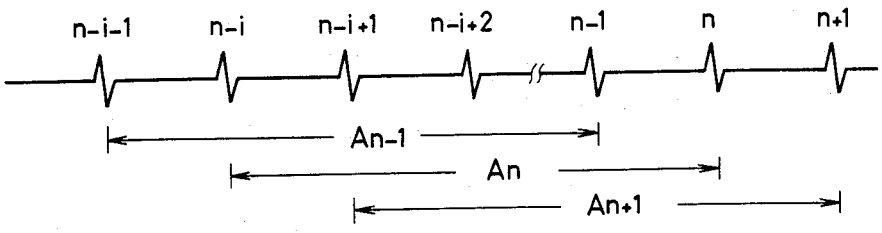
FIG. 3 is a diagram showing the counting operation of an Me counter in the circuit in FIG. 2.
Figure 5:
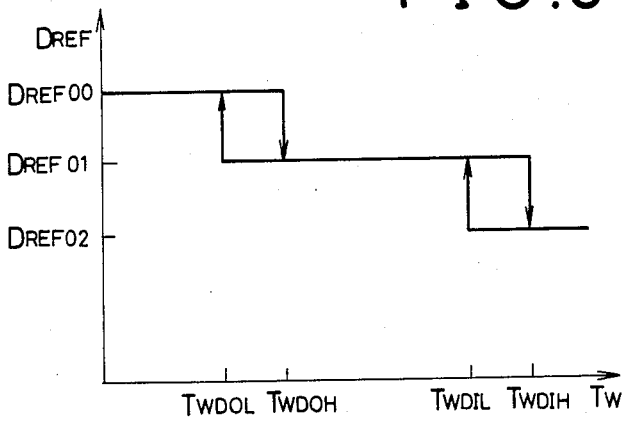
FIGS. 5 and 6 are setting characteristic graphs of a constant $D_{REF}$.

It is now assumed that the number of cylinders of the engine 4 is i and the TDC signals are intermittently generated as shown in FIG. 3. In this case, if the n−th TDC signal is supplied to the Me counter 25, the Me counter 25 outputs the count result corresponding to the period $A_n$ from the time point of the generation of the (n−i)th TDC signal that was generated only i pulses before until the time point of the generation of the n−th TDC signal. In a similar manner as above, when the (n+1)th TDC signal is supplied to the Me counter 25, it outputs the count result commensurated with the period $A_{n+1}$ from the generation time point of the (n−i+1)th TDC signal until the generation time point of the (n+1)th TDC signal. Namely, the period of one cycle (suction, compression, explosion, exhaust) of each cylinder is counted.

Figure 4:
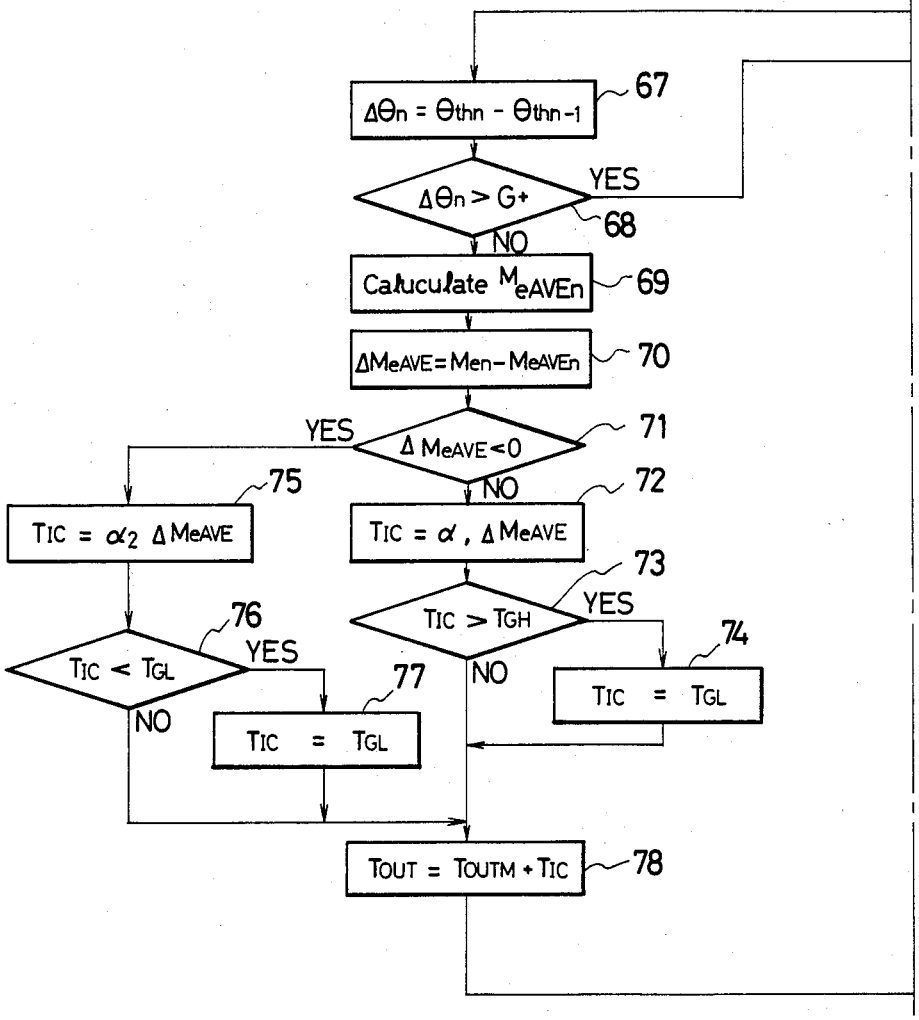
Figure 4:
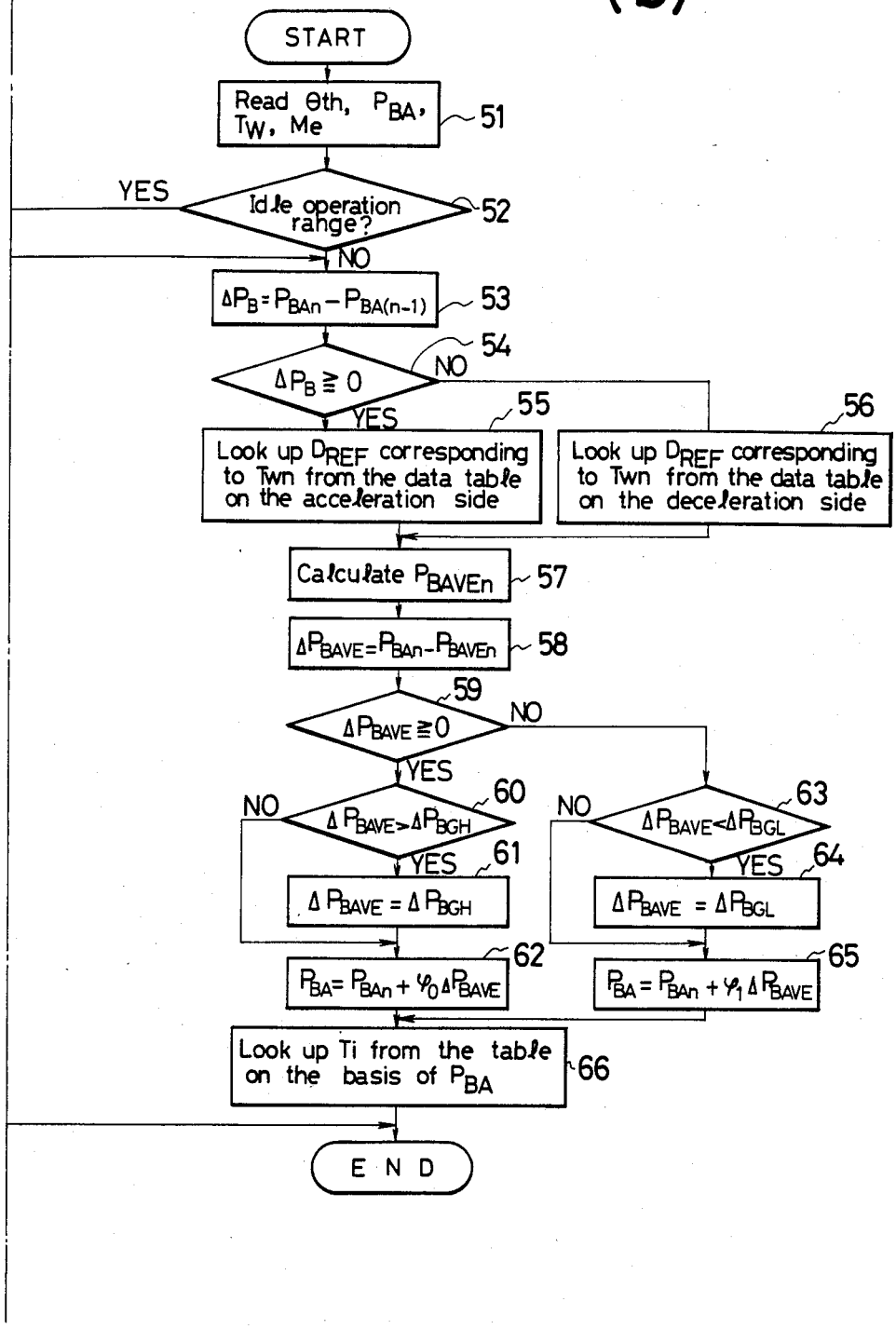

The procedure for the fuel supply controlling method according to the invention that is executed by the control circuit 16 will then be described with reference to an operation flowchart in FIG. 4.

Figure 6:
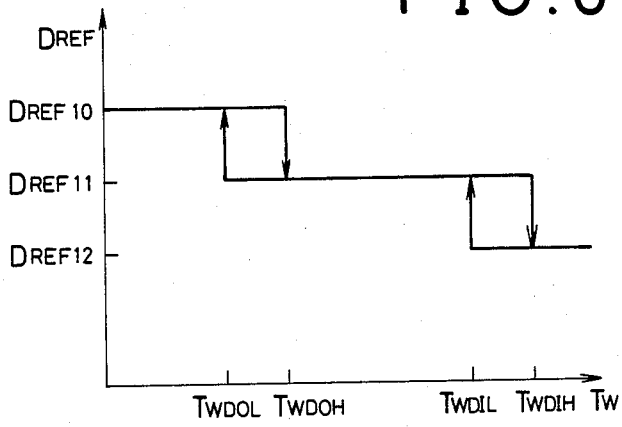

In this procedure, the throttle valve angular position $\theta_{th}$, intake air absolute pressure $P_{BA}$, coolant temperature $T_W$, and count value $M_e$ are respectively read synchronously with the n−th TDC signal and are set as present sampling values $\theta_{thn}$, $P_{BAn}$, $T_{Wn}$, and $M_{en}$ and these sampling values are stored into the RAM 29 (step 51). The sampling value $M_{en}$ of the count value $M_3$ corresponds to the period $A_n$. Next, a check is made to see if the engine 4 is in the idle operation range or not (step 52). This discrimination is made on the basis of the engine rotating speed $N_e$ which is derived from the count value $M_e$, the coolant temperature $T_W$ and the throttle valve angular position $\theta_{th}$. In other words, it is decided if the engine is in the idle operation range under the conditions of high coolant temperature, low angular position of the throttle valve and low engine speed. In other cases than the idle operation range, the preceding sampling value $P_{BA(n-1)}$ of one sampling before of the intake air absolute pressure $P_{BA}$ is read out from the RAM 29 and then the subtraction value $\Delta P_B$ between the present sampling value $P_{BAn}$ at this time and the previous sampling value $P_{BA(n-1)}$ is calculated (step 53). Subsequently, a check is made to see if the subtraction value $\Delta P_B$ is larger than 0 or not (step 54). If $\Delta P_B \geqq 0$, it is determined that the engine is being accelerated, so that a constant $D_{REF}$ corresponding to the sampling value $T_{Wn}$ of the coolant temperature $T_W$ is looked up (step 55) using the data table on the acceleration side of which such characteristics as shown is FIG. 5 have been preliminarily stored as data in the ROM 28. If $\Delta P_B < 0$, it is determined that the engine is being decelerated and a constant $D_{REF}$ corresponding to the sampling value $T_{Wn}$ of the coolant temperature $T_W$ is looked up (step 56) by use of the data table on the deceleration side of which such characteristics as shown in FIG. 6 have been preliminarily stored as data in the ROM 28 similarly to the case of $\Delta P_B \geqq 0$. The constant $D_{REF}$ gives a degree of averaging of the detection value $P_{BAn}$ of the pressure in the intake air passage until the present calculation. Even if the coolant temperatures are the same, the constant $D_{REF}$ upon acceleration is set to be larger than that upon deceleration. The constant $D_{REF}$ and constant A satisfy the relation of $1 \leqq D_{REF} \leqq A-1$. The constant A is used together with the constant $D_{REF}$ in equation (1) which will be mentioned later and serves to determine the resolution of the calculated value in equation (1). For instance, the constant A is set to 256 in the case where the CPU 27 is of the eight-bit type. After the constant $D_{REF}$ was set in this way, the reference value $P_{BAVE(n-1)}$ calculated one sampling before by means of the calculating equation (1)

$$P_{BAVEn} = (D_{REF}/A)P_{BAn} + \{(A - D_{REF})/A\}P_{BAVE(n-1)} \quad (1)$$

to obtain the objective value $P_{BAVEn}$ which is derived by averaging the sampling values $P_{BA1}$ to $P_{BAn}$ of the intake air absolute pressure is read out from the RAM 29, so that the present reference value $P_{BAVEn}$ is calculated from equation (1) (step 57). The amount of the fuel deposition onto the wall surface in the intake manifold is preliminarily considered for the reference value $P_{BAVEn}$. The subtraction value $\Delta P_{BAVE}$ between the sampling value $P_{BAn}$ and the objective value $P_{BAVEn}$ obtained is calculated (step 58). A check is made to see if the subtraction value $\Delta P_{BAVE}$ is larger than 0 or not (step 59). When $\Delta P_{BAVE} \geqq 0$, it is determined that the engine is being accelerated and then a check is made to see if the subtraction value $\Delta P_{BAVE}$ is larger than the upper limit value $\Delta P_{BGH}$ or not (step 60). If $\Delta P_{BA-}$ $_{VE}>\Delta P_{BGH}$, the subtraction value $\Delta P_{BAVE}$ is set to be equal to the upper limit value $\Delta P_{BGH}$ (step 61). If $\Delta P_{BAVE} \leqq \Delta P_{BGH}$, the subtraction value $\Delta P_{BAVE}$ in step 58 is maintained as it is. Thereafter, a correcting coefficient $\phi_0$ is multiplied to the subtraction value $\Delta P_{BAVE}$ and the sampling value $P_{BAn}$ is further added to the result of this multiplication, thereby obtaining the correction value $P_{BA}$ of the sampling value $P_{BAn}$ (step 62). On the other hand, in the case where $\Delta P_{BAVE}<0$ in step 59, a check is made to see if the subtraction value $\Delta P_{BAVE}$ upon deceleration is smaller than the lower limit value $\Delta P_{BGL}$ or not (step 63). If $\Delta P_{BAVE}<\Delta P_{BGL}$, the subtraction value $\Delta P_{BAVE}$ is set to be equal to the lower limit value $\Delta P_{BGL}$ (step 64). If $\Delta P_{BAVE} \geqq \Delta P_{BGL}$, the subtraction value $\Delta P_{BAVE}$ in step 58 maintained as it is. Thereafter, a correcting coefficient $\phi_1$ ($\phi_1>\phi_0$) is multiplied to the subtraction value $\Delta P_{BAVE}$ and the sampling value $P_{BAn}$ is further added to the result of this multiplication, so that the correction value $P_{BA}$ of the sampling value $P_{BAn}$ is calculated (step 65) similarly to step 62. After the correction value $P_{BA}$ was derived in this way, the basic fuel injection time duration $T_i$ is determined from the data table preliminarily stored in the ROM 28 on the basis of the correction value $P_{BA}$ and sampling value $M_{en}$ of the count value $M_e$ (step 66).

On the other hand, if it is determined that the engine is in the idle operation range in step 52, the subtraction value $\Delta\theta_n$ between the present sampling value $\theta_{thn}$ of the throttle valve angular position and the previous sampling value $\theta_{thn-1}$ is first calculated (step 67). A check is made to see if the subtraction value $\Delta\theta_n$ is larger than a predetermined value G+ or not (step 68). If $\Delta\theta_n>G+$, it is determined that the engine is being accelerated even in the idle operation range; therefore, it is presumed that the engine will be out of the idle operation range after the fuel injection time duration was calculated and the processing routine advances to step 53. If $\Delta\theta_n \leqq G+$, the reference value $M_{eAVE(n-1)}$ calculated one sampling before by means of the calculating equation (2)

$$M_{eAVEn}=(M_{REF}/A)M_{en}+\{(A-M_{REF})/A\}M_{eAVE(n-1)} \quad (2)$$

of the reference value $M_{eAVEn}$ which is derived by averaging the sampling value $M_{en}$ of the count value is read out from the RAM 29. In addition, the reference value $M_{eAVEn}$ is calculated from equation (2) by use of the constant A and $M_{REF}$ ($1 \leqq M_{REF} \leqq A-1$) (step 69). The constant $M_{REF}$ gives a degree of averaging of the detection value $M_{en}$ of said engine rotating speed or of the value of the inverse number of said engine rotating speed until the present calculation. The subtraction value $\Delta M_{eAVE}$ between the present sampling value $M_{en}$ of the count value $M_e$ and the reference value $M_{eAVEn}$ obtained is calculated (step 70). A check is made to see if the subtraction value $\Delta M_{eAVE}$ is smaller than 0 or not (step 71). When $\Delta M_{eAVE} \geqq 0$, it is determined that the actual engine rotating speed is lower than the reference engine speed corresponding to the reference value $M_{eAVEn}$, so that by multiplying a correcting coefficient 1 to the subtraction value $\Delta M_{eAVE}$, a correction time duration $T_{IC}$ is calculated (step 72). A check is made to see if the correction time duration $T_{IC}$ is larger than the upper limit time duration $T_{GH}$ or not (step 73). If $T_{IC}>T_{GH}$, it is decided that the correction time duration $T_{IC}$ derived in step 72 is too long, so that the correction time duration $T_{IC}$ is set to be equal to the upper limit time duration $T_{GH}$ (step 74). If $T_{IC} \leqq T_{GH}$, the correction time duration $T_{IC}$ in step 72 is maintained as it is. On the contrary, if $\Delta M_{eAVE}<0$ in step 71, it is determined that the actual engine rotating speed is higher than the reference engine speed responsive to the reference value $M_{eAVEn}$, so that the correction time duration $T_{IC}$ is calculated by multiplying a correcting coefficient $\alpha_2$ ($\alpha_2>\alpha_1$) to the subtraction value $\Delta M_{eAVE}$ (step 75). A check is made to see if the correction time duration $T_{IC}$ is smaller than the lower limit time duration $T_{GL}$ or not (step 76). If $T_{IC}<T_{GL}$, it is decided that the correction time duration $T_{IC}$ derived in step 75 is too short, so that the correction time duration $T_{IC}$ is set to be equal to the lower limit time duration $T_{GL}$ (step 77). If $T_{IC} \geqq T_{GL}$, the correction time duration $T_{IC}$ in step 75 is maintained as it is. After the correction time duration $T_{IC}$ was set in this way, the fuel injection time duration $T_{OUTM}$ is determined, in which the time duration $T_{OUTM}$ is obtained by correcting in accordance with various kinds of parameters the basic fuel injection time duration which is read out from the fuel injection time duration data table stored preliminarily in the ROM 28 on the basis of the present sampling values $P_{BAn}$ and $M_{en}$; furthermore, by adding the correction time duration $T_{IC}$ to the resultant fuel injection time duration $T_{OUTM}$, the fuel injection time $T_{OUT}$ is calculated (step 78).

In such a fuel supply controlling method according to the invention, the reference value $P_{BAVEn}$ of which the amount of the fuel deposited on the wall surface in the intake manifold is preliminarily considered for the sampling value $P_{BAn}$ of the intake air absolute pressure is set. Further, the reference values responsive to the acceleration and deceleration are calculated. The different correcting constant $\phi_1$ or $\phi_2$ is multiplied to the difference $\Delta P_{BAVE}$ between the actual detection value and the reference value in dependence on the positive or negative value of the value of the difference $\Delta P_{BAVE}$. The sampling value $P_{BAn}$ is further added to the result of this multiplication. In this way, the presumptive value $P_{BA}$ of the intake air absolute pressure is determined.

As described above, according to the fuel supply controlling method of the invention, the presumptive value of the pressure in the intake air passage in consideration of the correction values with regard to the time lag in control operation and to the fuel deposition on the wall surface in the intake air manifold is obtained. Consequently, the proper amount of the fuel supply into the engine can be determined and a driveability can be also improved.

What is claimed is:

1. A method for controlling the fuel supply of an internal combustion engine having a throttle valve in an intake air system, comprising the steps of:

detecting when an angular position of a crankshaft of the engine coincides with a predetermined crankshaft angular position;

detecting a pressure in an intake air passage downstream of said throttle valve whenever said coincidence is detected;

calculating a present reference value $P_{BAVEn}$ having a predetermined functional relation to a present detection value $P_{BAn}$ of said pressure in the intake air passage and a preceding reference value $P_{BAVE(n-1)}$ calculated by a preceding step of calculating a said reference value, and determining an amount of fuel supply into the engine on the basis of said present reference value $P_{BAVEn}$.

2. The method of claim 1 further comprising:

injecting a variable amount of fuel into said engine in response to said step of determining an amount of fuel supply.

3. The method of claim 2 wherein said steps of injecting a variable amount of fuel is performed by varying the time duration fuel is supplied to said engine.

4. A method according to claim 1, wherein said present reference value $P_{BAVEn}$ is derived by the equation:

$$P_{BAVEn}=(D_{REF}/A)\cdot P_{BAn}+\{(A-D_{REF})/A\}P_{BAVEn-1}$$

in which, A is a constant and $D_{REF}$ $(1 \leqq D_{REF} \leqq A-1)$ is a constant selected to provide a degree of averaging of the detection value $P_{BAn}$ of said pressure in the intake air passage until the present calculation.

5. A method according claim 4, wherein said constant $D_{REF}$ is varied in dependence upon a temperature of the engine.

6. A method according to claim 4, further comprising determining whether the engine is being accelerated or decelerated and setting said constant $D_{REF}$ in accordance with the result of said discrimination.

7. A method according to claim 6, wherein said acceleration and deceleration states of the engine are determined by said step of determining depending on a subtraction value $P_B$ between the present detection value $P_{BAn}$ of said pressure in the intake air passage and a preceding detection value $P_{BA(n-1)}$, and the constant $D_{REF}$ is set to be large in the case where it is determined that the engine is being accelerated than the value of the constant $D_{REF}$ in the case where it is decided that the engine is being decelerated.

8. A method according to claim 1, wherein said fuel supply amount is determined depending on a subtraction value $\Delta P_{BAVE}$ between said present detection value $P_{BAn}$ and said present reference value $P_{BAVEn}$.

9. A method according to claim 8, further comprises checking to determine if said subtraction value $P_{BAVE}$ is positive or negative, and multiplying a constant $\phi$, responsive to the result of said discrimination regarding positive or negative, to the subtraction value $P_{BAVE}$, said present detection value $P_{BAn}$ being further added to the result of said multiplication, and said fuel supply amount being determined on the basis of the value of said addition result.

10. In a system for controlling the fuel supply to an internal combustion engine having an intake air system including an intake air passage having a throttle valve disposed therein, a fuel injector for supplying fuel to the engine and a crankshaft position sensor sensing the angular position of an engine crankshaft, comprising:

first means, responsive to said crankshaft position sensor, for determining when the crankshaft has reached a predetermined angular position;

means for detecting pressure within said intake air passage downstream of said throttle valve upon detection of said predetermined angular position by said first means and developing a pressure signal representative thereof;

calculation means, responsive to said pressure signal generated by said means for detecting, for calculating a present reference valve $P_{BAVEn}$ having a predetermined functional relation to a present detection valve $P_{BAn}$ determined from said pressure signal and a preceding reference value $P_{BAVE(n-1)}$ determined from a previous value of said pressure signal; and second means, responsive to said means for calculating, for determining an amount of fuel to be supplied to the engine based on said present reference value $P_{BAVEn}$.

11. The system of claim 10 further comprising injector flow adjustment means, response to said amount of fuel determined by said second means, for adjusting the fuel flow of said fuel injector.

12. The system of claim 11 wherein said flow adjustment means varies the time duration of drive pulses supplied to said fuel injector.

13. The system of claim 11 wherein said second means determines the amount of fuel to be supplied to the engine from a subtraction value $\Delta P_{BAVE}$ between said present detection value $P_{BAn}$ and said present reference value $P_{BAVEn}$.

14. The method according to claim 13 wherein said means for calculating further comprises means for determining whether said subtraction value $\Delta P_{BAVE}$ is positive or negative and for multiplying a constant $\phi$ to said subtraction value $\Delta P_{BAVE}$ in response to the result of said discrimination regarding positive or negative, said present detection value $P_{BAn}$ being further added by said calculation means to the result of said multiplication to produce an output indicative thereof;

said second means determining the amount of fuel to be supplied to the engine in response to said output of said calculation means.

15. The system of claim 11 wherein said calculation means calculates said present reference value $P_{BAVEn}$ by the equation:

$$P_{BAVEn}=(D_{REF}/A)\cdot P_{BAn}+\{(A-D_{REF})/A\}P_{BAVEn-1}$$

where A is a constant and $D_{REF}$ $(1 \leqq D_{REF} \leqq A-1)$ is a constant selected to provide a degree of averaging of the detection value $P_{BAn}$ of said pressure in said intake air passage prior to said calculation.

16. The system of claim 15 further comprising temperature sensing means for sensing the temperature of said engine and producing a temperature output representative thereof;

said calculation means being responsive to said temperature output of said temperature sensing means to vary the constant $D_{REF}$ in dependence upon temperature of the engine.

17. The system of claim 15 wherein said calculation means includes means, responsive to said first means, for discriminating whether the engine is being accelerated or decelerated and for setting said constant $D_{REF}$ in accordance with the result thereof.

18. The system of claim 17 wherein said means for discriminating determines the acceleration and deceleration states of the engine in response to a subtraction value $P_B$ calculated by said calculation means from the present detection value $P_{BAn}$ of said pressure in the intake passage in a preceding detection value $P_{BA(n-1)}$;

said means for calculating being responsive to said means for discriminating and setting the constant $D_{REF}$ to be larger when said means for determining establishes that the engine is being accelerated then the value said calculating means sets said constant $D_{REF}$ to in the case where said means for determining determines that the engine is being decelerated.

* * * * *